US006918441B2

(12) United States Patent
Dallas

(10) Patent No.: US 6,918,441 B2
(45) Date of Patent: Jul. 19, 2005

(54) CUP TOOL FOR HIGH PRESSURE MANDREL

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 10 days.

(21) Appl. No.: 10/251,149

(22) Filed: Sep. 20, 2002

(65) Prior Publication Data

US 2004/0055742 A1 Mar. 25, 2004

(51) Int. Cl.[7] ..... E21B 33/126; E21B 33/03

(52) U.S. Cl. ..... 166/202; 166/387; 285/328; 285/110

(58) Field of Search ..... 166/379, 85.3, 166/196, 195, 202, 90.1, 121, 387; 285/110, 328, 338, 196, 216, 350

(56) References Cited

U.S. PATENT DOCUMENTS

| | | | | | |
|---|---|---|---|---|---|
| 2,972,379 | A | * | 2/1961 | Brown | 166/313 |
| 3,461,958 | A | * | 8/1969 | Brown | 166/361 |
| 3,485,297 | A | * | 12/1969 | Sutliff et al. | 166/121 |
| 3,566,962 | A | * | 3/1971 | Pease et al. | 166/121 |
| 3,796,260 | A | * | 3/1974 | Bradley | 166/153 |
| 3,830,304 | A | | 8/1974 | Cummings | 166/305 |
| 4,005,879 | A | * | 2/1977 | Berger et al. | 285/31 |
| 4,023,814 | A | | 5/1977 | Pitts | 277/181 |
| 4,111,261 | A | | 9/1978 | Oliver | 166/86 |
| 4,601,494 | A | | 7/1986 | McLeod | 285/110 |
| 4,867,243 | A | | 9/1989 | Garner et al. | 66/379 |
| 4,993,488 | A | | 2/1991 | McLeod | 166/72 |
| 5,012,865 | A | | 5/1991 | McLeod | 166/90 |
| 5,044,602 | A | * | 9/1991 | Heinonen | 251/1.1 |
| 5,048,613 | A | * | 9/1991 | Shilling | 166/387 |
| 5,261,487 | A | | 11/1993 | McLeod et al. | 166/77 |
| 5,396,956 | A | * | 3/1995 | Cherewyk et al. | 166/250.08 |
| 5,641,019 | A | * | 6/1997 | Stout et al. | 166/179 |
| 6,220,363 | B1 | | 4/2001 | Dallas | 166/382 |
| 6,247,537 | B1 | | 6/2001 | Dallas | 166/379 |
| 6,289,993 | B1 | | 9/2001 | Dallas | 166/386 |
| 6,364,024 | B1 | | 4/2002 | Dallas | 166/379 |
| 2004/0007366 | A1 | * | 1/2004 | McKee et al. | 166/387 |

FOREIGN PATENT DOCUMENTS

| | | | |
|---|---|---|---|
| CA | 1272684 | 8/1990 | 166/59 |

OTHER PUBLICATIONS

U.S. Appl. No. 09/537,629 entitled "Blowout Preventer Protector and Method of Using Same," filed Mar. 29, 2000.

* cited by examiner

*Primary Examiner*—David Bagnell
*Assistant Examiner*—Shane Bomar
(74) *Attorney, Agent, or Firm*—Nelson Mullins Riley & Scarborough, LLP

(57) ABSTRACT

A cup tool for use with a mandrel of a wellhead isolation tool has a substantially right-angled stepped shoulder over which an elastomeric sealing element is forced by elevated fluid pressures. A top end of the elastomeric sealing element is inhibited from extrusion past the stepped shoulder during the insertion of the mandrel, thereby reducing the risk of damaging the sealing element before the mandrel is fully inserted through the wellhead. Once the sealing element is exposed to elevated fluid pressures, the top end of the elastomeric sealing element is forced upwardly over the stepped shoulder, and extruded into an annulus between the mandrel and a well casing or production tubing to provide a high-pressure fluid seal.

21 Claims, 6 Drawing Sheets

CUP TOOL FOR HIGH PRESSURE MANDREL

FIELD OF THE INVENTION

This invention generally relates to wellhead isolation tools, and, in particular, to a cup tool component of a wellhead isolation tool for isolating pressure-sensitive wellhead components during high-pressure fracturing and stimulating of oil and gas wells.

BACKGROUND OF THE INVENTION

Most oil and gas wells eventually require some form of stimulation to enhance hydrocarbon flow to make or keep them economically viable. The servicing of oil and gas wells to stimulate production requires the pumping of fluids under high pressure. The fluids are generally corrosive and abrasive because they are frequently ladened with corrosive acids and abrasive propants such as sharp sand.

In order to protect the components which make up the wellhead, such as the valves, tubing hanger, casing hanger, casing head and the blowout preventer equipment, wellhead isolation tools are used during fracturing and stimulating procedures. The wellhead isolation tools generally insert a mandrel through the various valves and spools of the wellhead to isolate those components from the elevated pressures and from the corrosive and abrasive fluids used in the well treatment to stimulate production. One example of those well isolation tools is described in the Applicant's U.S. patent application Ser. No. 09/537,629, entitled BLOWOUT PREVENTER PROTECTOR AND METHOD OF USING SAME filed Mar. 29, 2000. Another example of such a tool is described in the Applicant's U.S. Pat. No. 4,867,243 which issued Sep. 19, 1989 and is entitled WELLHEAD ISOLATION TOOL AND SETTING TOOL AND METHOD OF USING SAME. In those examples a top end of the mandrel is connected to one or more high pressure valves through which the stimulation fluids are pumped. A pack-off assembly is provided at a bottom end of the mandrel for achieving a fluid seal against an inside of the production tubing or well casing, so that the wellhead is completely isolated from the stimulation fluids.

Various pack-off assemblies provided at a bottom end of the mandrel of wellhead isolation tools are described in other prior art patents, such as U.S. Pat. No. 4,023,814, entitled A TREE SAVER PACKER CUP, which issued to Pitts on May 17, 1977; U.S. Pat. No. 4,111,261, entitled A WELLHEAD ISOLATION TOOL, which issued to Oliver on Sep. 5, 1978; U.S. Pat. No. 4,601,494, entitled A NIPPLE INSERT, which issued to McLeod et al. on Jul. 22, 1986, and Canadian Patent 1,272,684, entitled A WELLHEAD ISOLATION TOOL NIPPLE, which issued to Sutherland-Wenger on Aug. 14, 1990. These pack-off assemblies include a cup tool that radially expands under high fluid pressures to seal against the inside wall of a production tubing or casing.

In an effort to improve existing pack-off assemblies and to further improve the high pressure seal, McLeod et al. in U.S. Pat. No. 5,261,487, entitled PACKOFF NIPPLE, which issued on Nov. 16, 1993, describe a packoff nipple for use on a mandrel of a wellhead isolation tool. This tool is described below with reference to FIGS. 1—3.

FIG. 1 shows McLeod et al's sealing nipple assembly 100, which is attached to the wellhead isolation tool mandrel 98, in a non-actuated condition. The sealing nipple assembly 100 includes a cylindrical nipple body 104, which slidably receives thereon an elastomeric primary seal 106 having a forward lip (more clearly shown in FIG. 2) and an elastomeric packer ring 108. The elastomeric primary seal 106 and the elastomeric packer ring 108 are bonded to respective rigid seal rings 110 and 112 such that the elastomeric primary seal 106 and the elastomeric packer ring 108 are axially movable relative to the cylindrical nipple body 104. O-rings 114 and 116 are provided between the cylindrical nipple body 104 and the respective rigid seal rings 110 and 112. The axial movements of the elastomeric primary seal 106 and the elastomeric packer ring 108 are restrained between a shoulder 118 of the cylindrical nipple body 104 and a shoulder sub 120. The cylindrical nipple body has a bottom end that terminates in a bullnose 122 for guiding the pack-off nipple assembly 100 into the tubing 96. The shoulder sub 120 which is threadedly connected to the top end of the cylindrical collar 104 has a lower end having two angular shoulders 126 and 128.

Under elevated fluid pressures 132, as shown in FIGS. 2 and 3, the elastomeric primary seal 106 expands radially to establish a primary seal between the pack-off nipple assembly 100 and the tubing 96 such that the elastomeric primary seal 106 is forced upwardly to move the elastomeric packer ring 108 upwardly against angled first and second shoulders 126, 128 of the shoulder sub 120. A sealing shoulder 130 of the elastomeric packer ring 108 is forced upwardly under high fluid pressures 132, over the first angled shoulder 126, and extrudes into an annular gap between the tubing 96 and the external periphery of the lower angular shoulder 126. This is shown in FIG. 2. When the fluid pressures 132 are further elevated, the elastomeric packer ring 108 is forced further upward and the sealing shoulder 130 further intrudes into an annular gap between the tubing 96 and the second angled shoulder 128, as shown in FIG. 3. Thus, the elastomeric pack-off nipple assembly 100 provides a seal between the mandrel 98 and the tubing 96 in order to inhibit fluid leakage under very high fluid pressures, until the mandrel 98 is withdrawn from the tubing 96, which causes the sealing shoulder 130 of the elastomeric packer ring 108 to slide off the angular shoulders 126 and 128.

The elastomers used for the primary seal 106 and the packer ring 108 are of different hardness. The packer ring 108 is preferably made of an elastomer having a greater durometer than that of the primary seal 106. Thus, the harder packer ring 108 is able to withstand greater wear, while the softer primary seal 106 is able to flex when the nipple assembly 100 is inserted into the tubing 96. Preferred durometer values are 80 for the primary seal 106 and 95 for the elastomeric packer ring 108.

Although McLeod et al's pack-off nipple assembly is reported to provide an adequate seal, the assembly has at least one disadvantage. During insertion of the mandrel, the elastomeric packer ring 108 may be prematurely actuated to extrude into the annular gap between the tubing 96 and the respective angled shoulders 126, 128. This can occur when the primary seal 106 and the elastomeric packer ring 108 are forced through a constriction in a wellhead during the insertion of the mandrel 98 into the tubing 96. The frictional forces acting on the primary seal 106 and the elastomeric packer ring 108 can cause the elastomeric packer ring 108 to be frictionally trapped while the pack-off nipple assembly 100 is moving downwardly with the mandrel 98. The angled first and second shoulders 126 and 128 readily permit the sealing shoulder 130 of the elastomeric packer ring 108 to move upwardly. Once this occurs, the further insertion of the mandrel 98 can tear the elastomeric packing ring 108, which may result in a malfunction of the tool.

There is therefore, a need for further improvements in pack-off assemblies for use with a mandrel of wellhead isolation tools.

SUMMARY OF THE INVENTION

It is therefore an object of the invention is to provide a sealing assembly for use with a mandrel of wellhead isolation tools that provides a secure seal between the mandrel and a tubing into which the mandrel is inserted against high fluid pressures, but is highly resistant to seal damage induced by movement through restrictions in a passage through a wellhead.

A further object of the invention is to provide a cup tool that is simple and inexpensive to construct.

The invention therefore provides a cup tool for providing a high-pressure fluid seal in an annulus between a high pressure mandrel and a casing of a production tubing in a wellbore. The cup tool comprises a cup tool tube having a threaded upper end for connection to the high-pressure mandrel with a stepped shoulder at an upper end of the cup tool tube. The stepped shoulder includes at least two substantially right-angled steps. An elastomeric sealing element is slidably received on the cup tool tube. The elastomeric sealing element has a top end with a square top edge that engages the stepped shoulder when the elastomeric sealing element is forced upwardly over the cup tool tube by fluid pressure. Thus, the top end of the elastomeric sealing element is adapted to be forced upwardly and over one or more of the right-angled steps when the elastomeric sealing element is exposed to elevated fluid pressures, thereby extruding into the annulus in order to provide the high-pressure fluid seal.

The elastomeric sealing element may comprise a unitary elastomeric cup. The unitary elastomeric cup may comprise a single elastomer of a consistent durometer, so that it is simple and inexpensive to manufacture.

The invention further provides a gauge ring for a cup tool. The gauge ring comprises an outer periphery that includes a stepped shoulder having at least two substantially right-angle steps that respectively include a radial surface and an axial surface oriented at a right angle with respect to each other, the right angle steps inhibiting upward movement of an elastomeric sealing element of the cup tool until the elastomeric sealing element is exposed directly or indirectly to elevated fluid pressure.

The gauge ring may be frictionally supported on the cup tool tube, or threadedly connected to the cup tool tube or to a connector sub for connecting the cup tool tube to the mandrel.

The invention further provides a cup tool for providing a high-pressure fluid seal in an annulus between a high pressure mandrel and a casing or a production tubing in a wellbore. The cup tool comprises a first cup tool tube having a threaded upper end for connection to the high-pressure mandrel, and a first stepped shoulder at an upper end of the first cup tool tube. The first stepped shoulder includes at least two substantially right-angled steps. A first elastomeric sealing element is slidably received on the first cup tool tube, the first elastomeric sealing element having a top end with a square top edge that engages the first stepped shoulder when the first elastomeric sealing element is forced upwardly over the first cup tool tube by fluid pressure. The cup tool further includes a second cup tool tube having a threaded upper end for connection to the first cup tool tube, and a second stepped shoulder at an upper end of the second cup tool tube. The second stepped shoulder likewise includes at least two substantially right-angled steps. A second elastomeric sealing element is slidably received on the second cup tool tube. The second elastomeric sealing element has a top end with a square top edge that engages the second stepped shoulder when the second elastomeric sealing element is forced upwardly over the second cup tool tube by fluid pressure. Thus, the top end of the respective first and second elastomeric sealing elements are adapted to be forced upwardly against and over one or more of the respective steps when the elastomeric sealing element is exposed to elevated fluid pressure, thereby extruding into the annulus in order to provide the high-pressure fluid seal.

The invention thereby provides a cup tool that is simple and inexpensive to manufacture. The cup tool also performs well and is not prone to becoming stuck in the wellhead as it is forced through restrictions in a passage through the wellhead. Since upward movement of the square top shoulder of the elastomeric sealing element is resisted by the square steps at a top of the cup tool tube, the sealing element does not readily extrude and bind as the cup tool is forced through the wellhead. Wear and tear on the elastomeric sealing element are thus reduced, the overall life of the sealing element is prolonged, and a more reliable seal is achieved.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides cup tool for achieving a high-pressure fluid seal in an annulus between a high pressure mandrel and a casing or a production tubing in a wellbore. The cup tool includes a cup tool tube having a threaded upper end for connection to the high-pressure mandrel, an elastomeric sealing element that is slidably received on the cup tool tube, and a stepped shoulder at the upper end of the cup tool tube, the stepped shoulder including at least two substantially right-angled steps. A top end of the elastomeric sealing element is forced upwardly and over one or more of the steps when the elastomeric sealing element is exposed to elevated fluid pressures, thereby extruding into the annulus in order to provide the high-pressure fluid seal.

Figure 4:
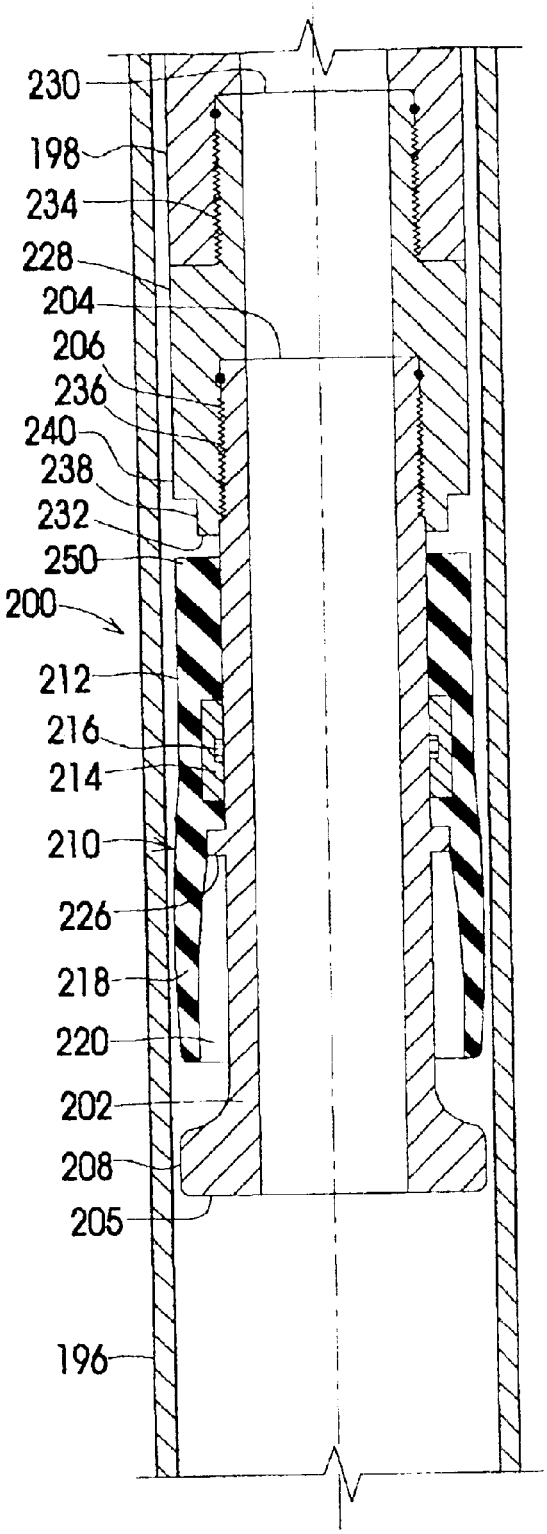
FIG. 4 is a cross-sectional view of a cup tool in accordance with one embodiment of the invention in an un-actuated condition.
Figure 5:
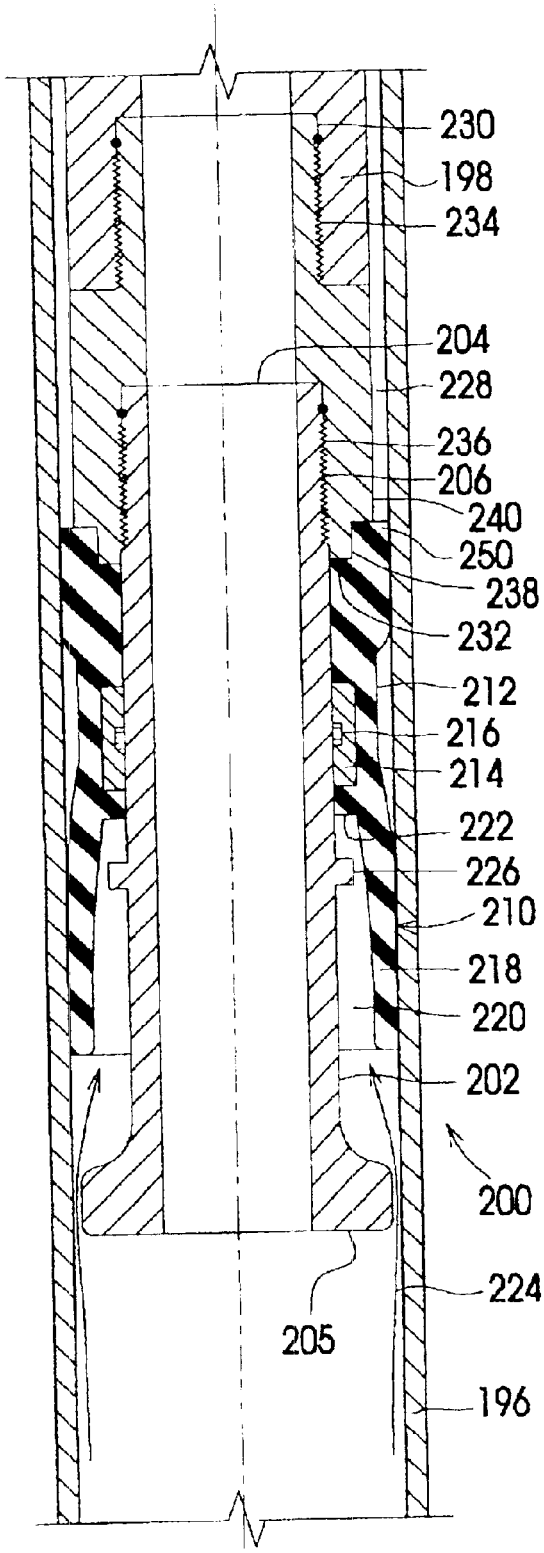
FIG. 5 is a cross-sectional view showing the embodiment shown in FIG. 4 in a first sealing position.
Figure 6:
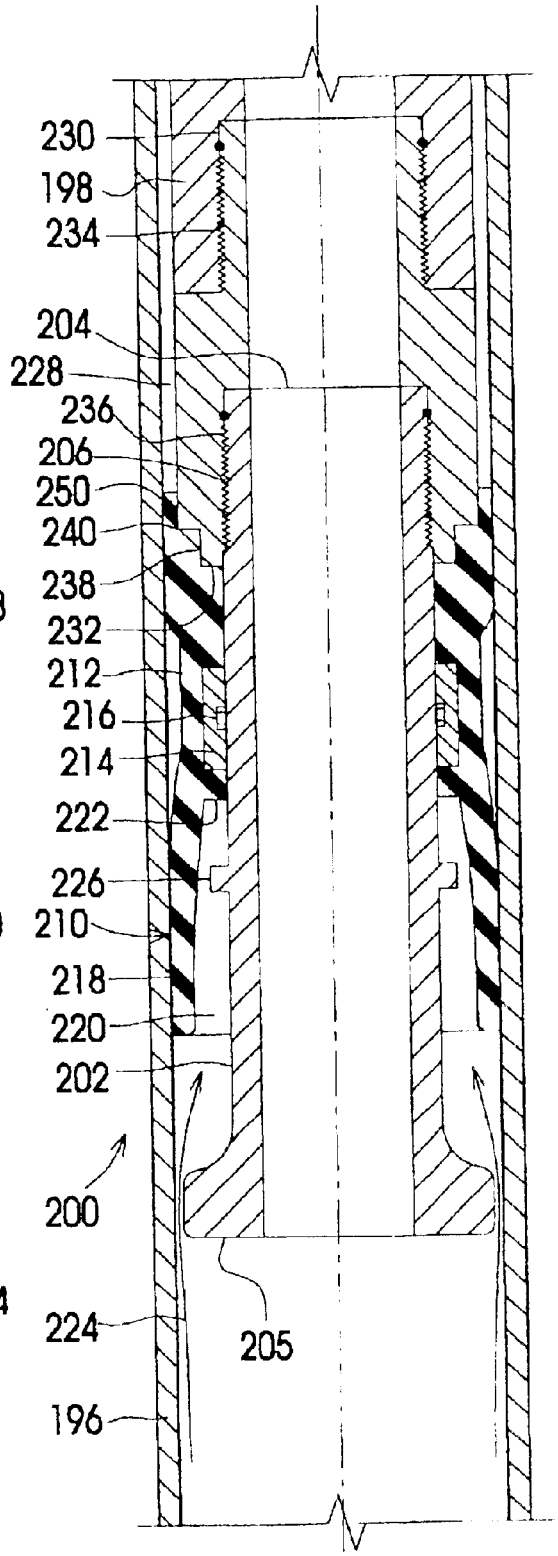
FIG. 6 is a cross-sectional view showing the embodiment shown in FIG. 4 in a second sealing position.
Figure 8:
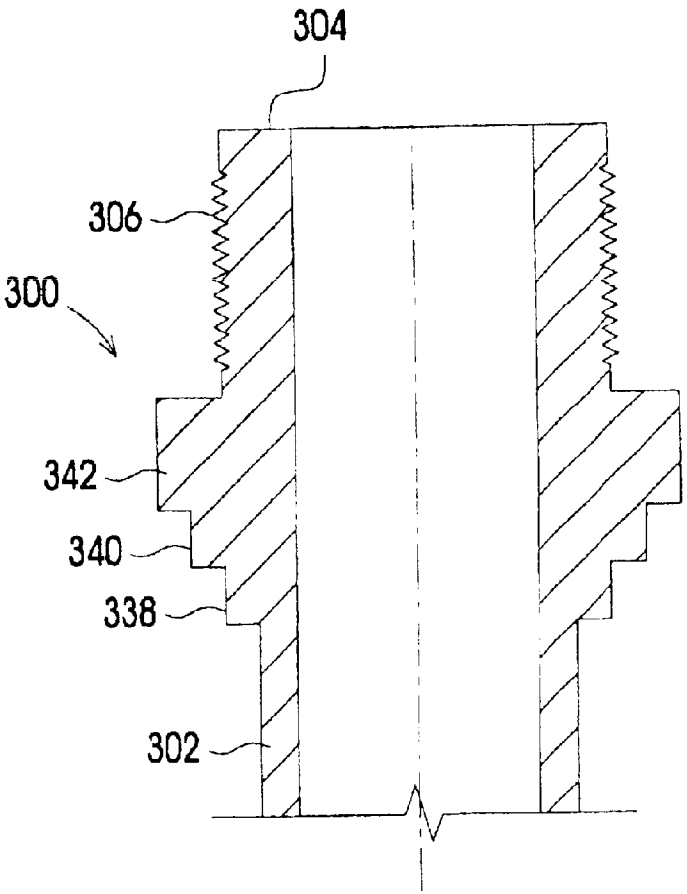
FIG. 8 is a cross-sectional view showing a stepped shoulder configuration in accordance with another embodiment of the invention.

As shown in FIGS. 4–6, a cup tool in accordance with one embodiment of the invention, generally indicated by reference numeral 200 is attached to a bottom end of a mandrel 198 and is inserted into a production tubing or well casing, hereinafter referred to simply as a tubing 196. The cup tool 200 includes a cup tool tube 202 which has an upper end 204 provided with external threads 206 thereon. The cup tool tube 202 terminates at its bottom end 205 in a bullnose 208 which guides the cup tool 200 through a wellhead (not shown) and the tubing 196, and helps protect an elastomeric sealing element, such as elastomeric cup 210 operatively mounted to the cup tool 200. Although the bullnose 208 is shown to be an integral part of the cup tool, it may be a separate element that is threadedly connected to the cup tool tube.

The elastomeric cup 210 includes a cup body 212 slidably surrounding the cup tool tube 202. The cup body 212 is bonded to a cylindrical metal ring 214, preferably made of steel. The metal ring 214 is slidably received on the cup tool tube 202 and includes a groove in its inner periphery. An O-ring 216 provides a fluid seal between the metal ring 214 and the cup tool tube 202. The elastomeric cup 210 further includes a depending skirt 218, which extends downwardly from the cup body 212 and is formed integrally therewith. The skirt 218 has an outer diameter that is about the same as, or slightly larger than, the inner diameter of the tubing 196. The depending skirt 218 is open at its bottom end, and forms a sealed cavity around the cup tool tube 202 that is closed at a top end by a radial wall 222 (see FIGS. 5 and 6) such that when the elastomeric cup 210 is exposed to fluid pressures 224, the skirt 218 forces the elastomeric cup 210 to move up upwardly on the cup tool tube 202.

A stop shoulder 226 extends radially outwardly from the cup tool tube 202. The radial wall 222 of the elastomeric cup 210 rests on the stop shoulder 226 before the cup tool 200 is actuated, as shown in FIG. 4.

The cup tool 200 may further include a connector sub 228 having an upper end 230 and a lower end 232. External threads 234 are provided on the upper end 230 of the connector sub 228 for detachable connection to a threaded bottom end of the mandrel 198. Internal threads 236 are provided on the lower end 232 of the connector sub 228 for detachable connection to the external threads 206 on the upper end 204 of the cup tool tube 202. The connector sub 228 and the cup tool tube 202 each have a central passage preferably having a diameter equal to the internal diameter of the mandrel 198, as shown in FIGS. 4–6. O-rings provide a seal between the connector sub 228 and the mandrel 198, and between the cup tool tube 202 in order to prevent fluid leakage therebetween.

Figure 7:
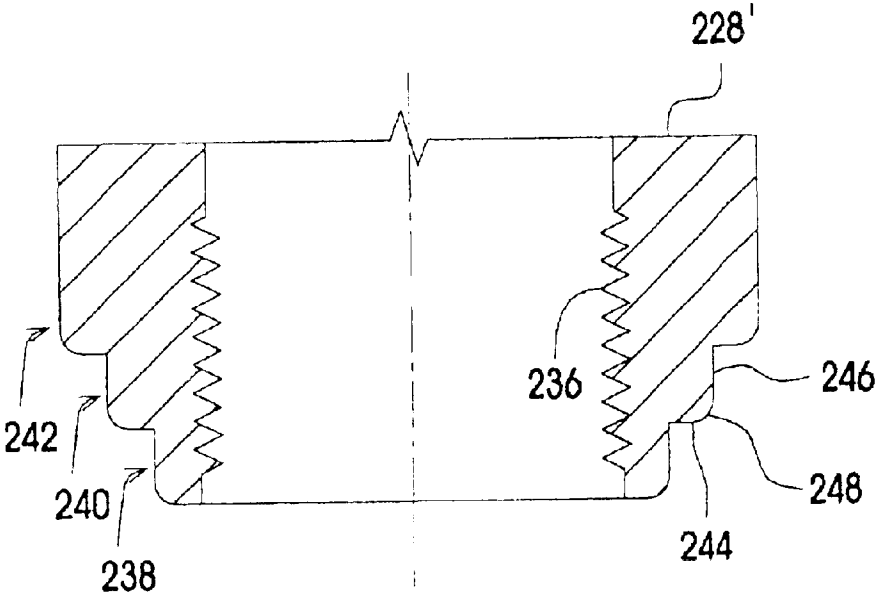
FIG. 7 is an enlarged partial cross-sectional view of the embodiment shown in FIG. 4, showing a stepped shoulder of a connector sub in more detail.

A stepped shoulder is provided on the lower end 232 of the connector sub 228 and includes at least two substantially right-angled, annular steps, indicated by reference numerals 238 and 240. The details of the stepped shoulder are described with reference to FIG. 7, which illustrates a connector sub 228' having three substantially right-angled steps 238, 240 and 242. Each of the steps includes a radial surface 244 and an axial surface 246 smoothly joined by an optionally rounded edge 248. The advantages of this particular configuration of the stepped shoulder will be further described below.

As illustratede in FIG. 4, the annular steps 238 and 240 surround a top of the cup tool tube 202 above the elastomeric cup 210 when the connector sub 228 is threadedly connected to the upper end 204 of the cup tool tube 202. When the cup tool 200 is actuated by elevated fluid pressures as illustrated in FIGS. 5 and 6, the elastomeric cup 210 is forced by the fluid pressure to move upwardly towards the steps 238 and 240. The number and width of the steps are designed such that a square edge of the top end 250 of the cup body 212 of the elastomeric cup 210 can be forced upwardly by elevated fluid pressures to ride over at least the lower step 238 and extrude into the annulus formed between the tubing 196 and the lower step 238, thereby providing a secure seal therebetween, as shown in FIG. 5. When the fluid pressure is high enough, the top end 250 of the elastomeric cup body 212 is forced further upwardly and rides over the upper step 240. The elastomeric cup then extrudes into the annulus formed between the tubing 196 and the upper step 240, thereby previding an even more secure seal, therebetween, as shown in FIG. 6.

The top end 250 of the cup body 212 of the elastomeric cup 210 abuts the radial annular surface 244 (FIG. 7) of the lowest step 238 when the cup tool 200 is forced through restrictions in a wellhead as the mandrel 198 is inserted into a wellbore. However, the flat annular surface 244 of the shoulder 238 inhibits upward movement of the square top end 250 of the elastomeric cup 210. Thus, premature actuation of the cup tool 200 during the insertion of the mandrel 198 through the wellhead is effectively inhibited, thereby reducing the probability of potential damage to the cup tool 200. The width of the steps, particularly the width of the lowest step 238 is selected to be wide enough to prevent the premature actuation of the cup tool 200, but not so wide as to prevent the top end 250 of the cup body 212 of the elastomeric cup 210 from being forced up and over the step 238 when subjected to elevated fluid pressures. The force acting on the elastomeric cup 210 caused by elevated fluid pressures is usually much greater than the frictional force caused by restrictions in the wellhead through which the elastomeric cup 210 is moved during the insertion of the mandrel 198.

The number of steps is a matter of design choice. Two, three or more steps can be used, depending on the size of a cup tool. However, since a primary purpose of the stepped shoulder is to inhibit upward migration of the elastomeric cup 210 until the mandrel 198 is fully inserted through the wellhead, many small steps are not desirable.

Additional embodiments of the invention are shown in FIGS. 8–11. In accordance with one embodiment, the cup tool 300 illustrated in FIG. 8 includes a cup tool tube 302 which includes an upper end 304 provided with external threads 306. The stepped shoulder is integrally formed with the cup tool tube 302. The stepped shoulder includes, for example, three right-angled steps 338, 340 and 342. Thus, the cup tool tube 302 is adapted to be connected directly to the threaded bottom end of the mandrel 198 shown in FIG. 4, without need of the connector sub 228. The remaining parts of the cup tool tube 302 and other components of the cup tool 300 are similar to the corresponding ones of the cup tool 200 shown in FIG. 4 and are not be redundantly illustrated or described.

Figure 9:
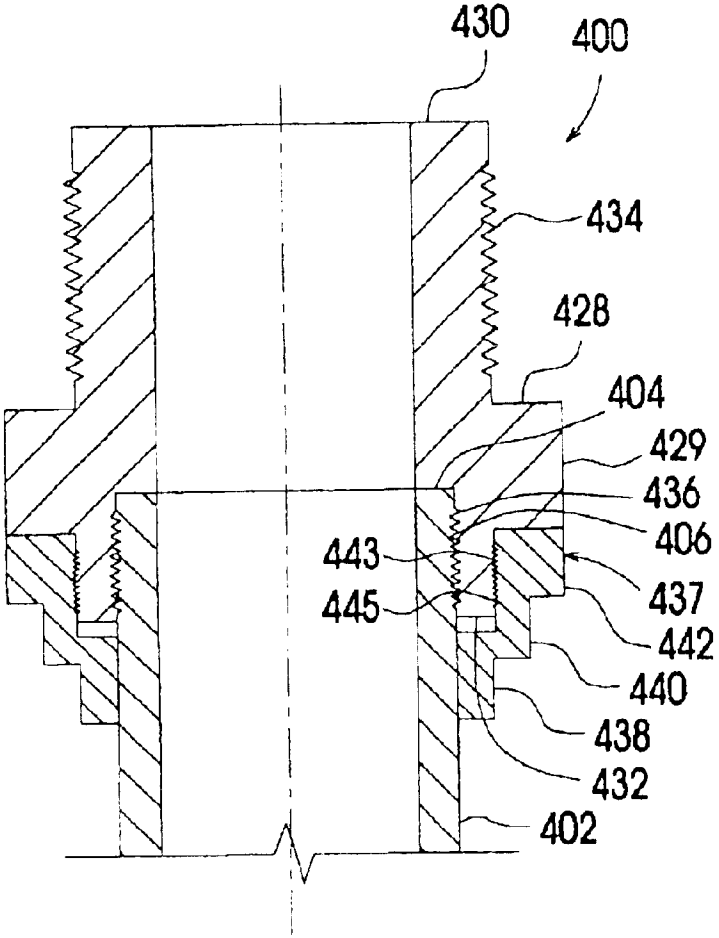
FIG. 9 is a cross-sectional view showing a stepped shoulder configuration in accordance with yet another embodiment of the invention.

FIG. 9 illustrates a stepped shoulder configuration in accordance with a further embodiment of the present invention. The cup tool 400 includes a connector sub 428 having an upper end 430 and a lower end 432. The upper end 430 is provided with external threads 434 adapted to detachably connect to the threaded lower end of the mandrel 198 shown in FIG. 4. The lower end 432 of the connector sub 428 is provided with internal threads 436 for detachable engagement with external threads 406 on the upper end 404 of the cup tool tube 402. A gauge ring 437 has an external periphery machined to include the substantially right-angled steps 438, 440 and 442. Internal threads 443 are provided on an internal periphery of the gauge ring 437 for detachable engagement with external threads 445, which are provided on the lower end 432 of the connector sub 428. Thus, the gauge ring 437 is adapted to be detachably connected to the lower end 432 of the connector sub 428. A shoulder 429 is provided on the connector sub 428 such that the gauge ring 437 abuts the lower surface of the shoulder 429 when the gauge ring 437 is threadedly received on the bottom end 432 of the connector sub 428. The remaining parts of the cup tool tube 402 and other components of the cup tool 400 are similar to the corresponding ones of the cup tool 200 shown in FIG. 4, and are not redundantly illustrated or described. The advantage of the stepped shoulder configuration shown in FIG. 9 resides in the exchangeability of the gauge ring 437, which may be replaced to accommodate variations in an inner diameter on the tubing 196.

Figure 10:
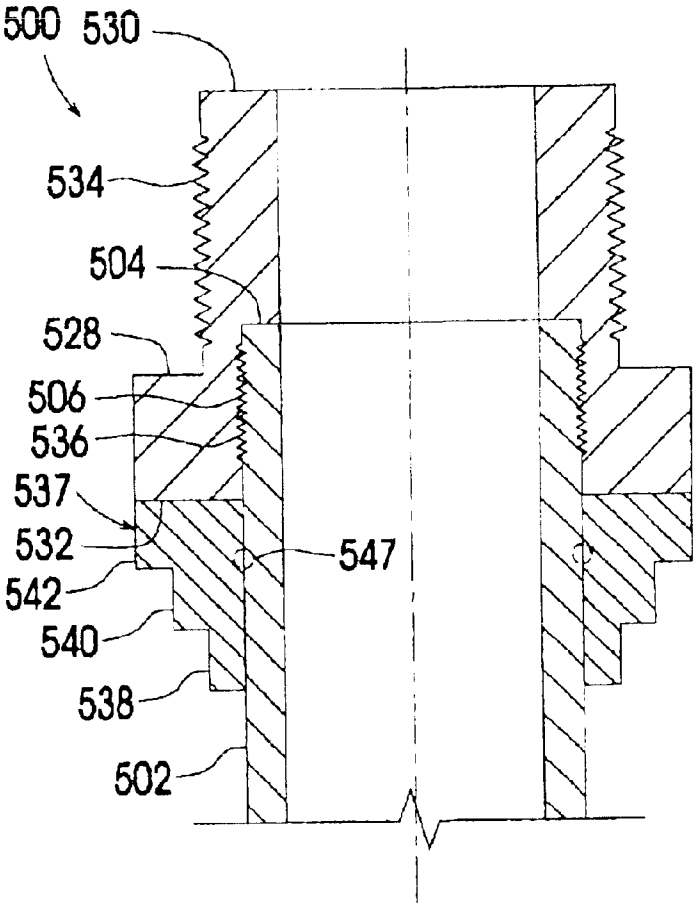
FIG. 10 is a cross-sectional view showing a stepped shoulder configuration in accordance with a further embodiment of the invention.

FIG. 10 illustrates a stepped shoulder configuration in accordance with another embodiment of the present invention. A cup tool 500 includes a cup tool tube 502 having an upper end 504 provided with external threads 506. A connector sub 528 includes an upper end 530 and a lower end 532. External threads 534 are provided on the upper end 530 of the connector sub 528, for detachable connection to the threaded bottom end of the mandrel 198 shown in FIG. 4, and internal threads 536 are provided on the lower end 532 of the connector sub 528 for detachable connection to the external threads 506 of the upper end 504 of the cup tool tube 502. A gauge ring 537 has an external periphery machined to form the substantially right-angled steps 538, 540 and 542. The gauge ring 537 is fitted on the cup tool tube 502 and held in place by frictional forces while the gauge ring 537 abuts the bottom end 532 of the connector sub 528. An O-ring 547 is optionally provided between the gauge ring 537 and the cup tool tube 502. In the same way as described above with reference to FIG. 9, the gauge ring 537 is replaceable.

Figure 11:
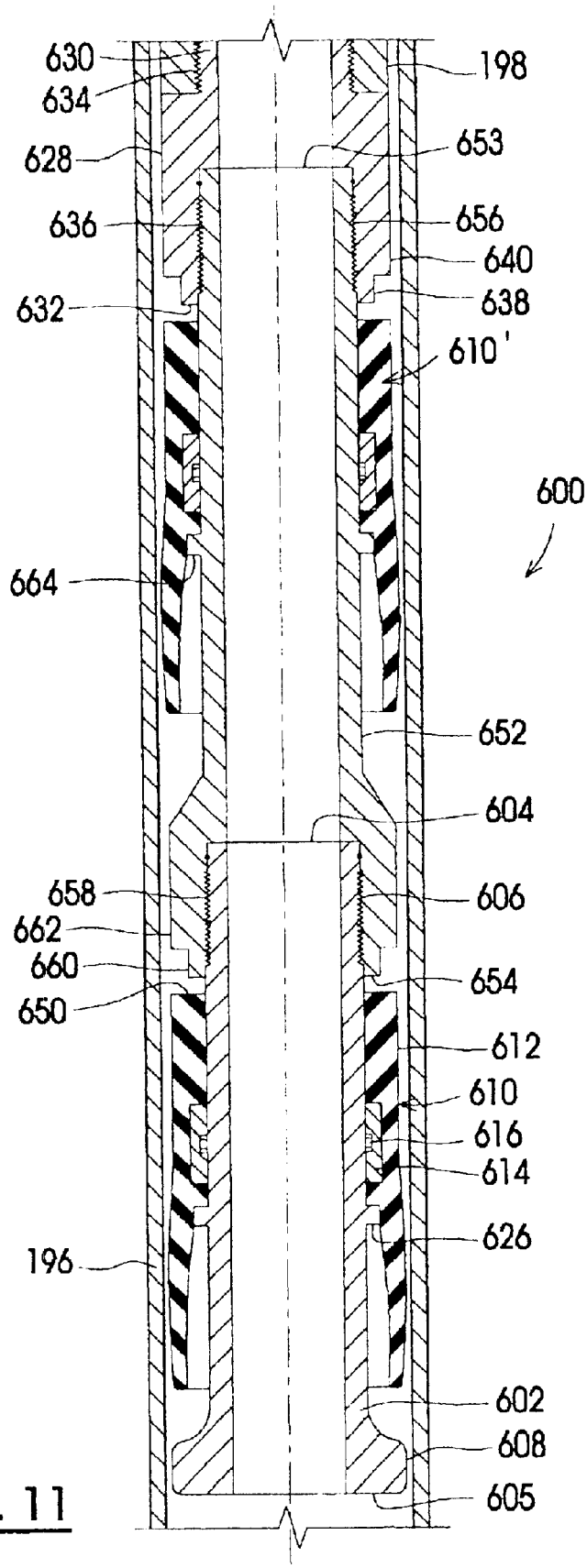
FIG. 11 is a cross-sectional view of another embodiment of the invention, which provides a double cup tool.

FIG. 11 illustrates a double cup tool 600 in accordance with another embodiment of the invention. The double cup tool 600 includes a cup tool tube 602. The cup tool tube 602 includes an upper end 604 and a bottom end 605. External threads 606 are provided on the top end 604. The cup tool tube 602 terminates at its bottom end 605 with a bullnose 608 for guiding the double cup tool 600 into the tubing 196 and protecting elastomeric cup 610 of the double cup tool 600. The elastomeric cup 610 which will be referred to below as the first elastomeric cup, rests against a stop shoulder 626 in an unactuated condition. The first elastomeric cup 610 is identical to the elastomeric cup 210 shown in FIG. 4. Therefore the configuration and features of the first elastomeric cup 610 are not redundantly described.

The double cup tool 600 further includes a second cup tool tube 652 having a top end 653 and a bottom end 654. External threads 656 are provided on the top end 652 and internal threads 658 are provided on the bottom end 654 for detachable connection with the external threads 606 of the upper end 604 of the cup tool tube 602 (which will be referred to hereinafter as the first cup tool tube). The lower end 654 of the second cup tool tube 652 includes a stepped shoulder with substantially right-angled steps 660 and 662. The annular shoulders 660 and 662 surround the first cup tool tube 602 above the top end 650 of the first elastomeric cup 610 when the second cup tool tube 652 is secured to the top end 604 of the first cup tool tube 602. A second elastomeric cup 610' slidably surrounds the second cup tool tube 652 and rests on a stop shoulder 664. The external threads 656 on the upper end 653 of the second cup tool tube 652 detachably engage the internal threads 636 on a lower end 632 of a connector sub 628, which is identical to the connector sub 228 shown in FIG. 4. The connector sub 628 has an upper end 630 provided with external threads 634 for detachable connection to a threaded lower end of the mandrel 198. The connector sub 628 at its lower end 632, also includes a stepped shoulder, which includes the substantially right-angled steps 638 and 640. O-rings are preferably provided between the second cup tool tube 652 and the respective first cup tool tube 602 and the connector sub 628 to inhibit fluid leaks.

The double cup tool 600 shown in FIG. 11 is inserted into the tubing 196 and is in an unactuated position. The double cup tool 600 operates under the same principles as the other embodiments of the invention, but provides a more secure seal, particularly under very elevated fluid pressure conditions. The second elastomeric cup 610' works as a backup seal and is actuated to provide secure sealing between the mandrel 198 and the tubing 196, in order to prevent fluid leakage if the first elastomeric cup 610 does not provide an adequate seal.

Figure 1:
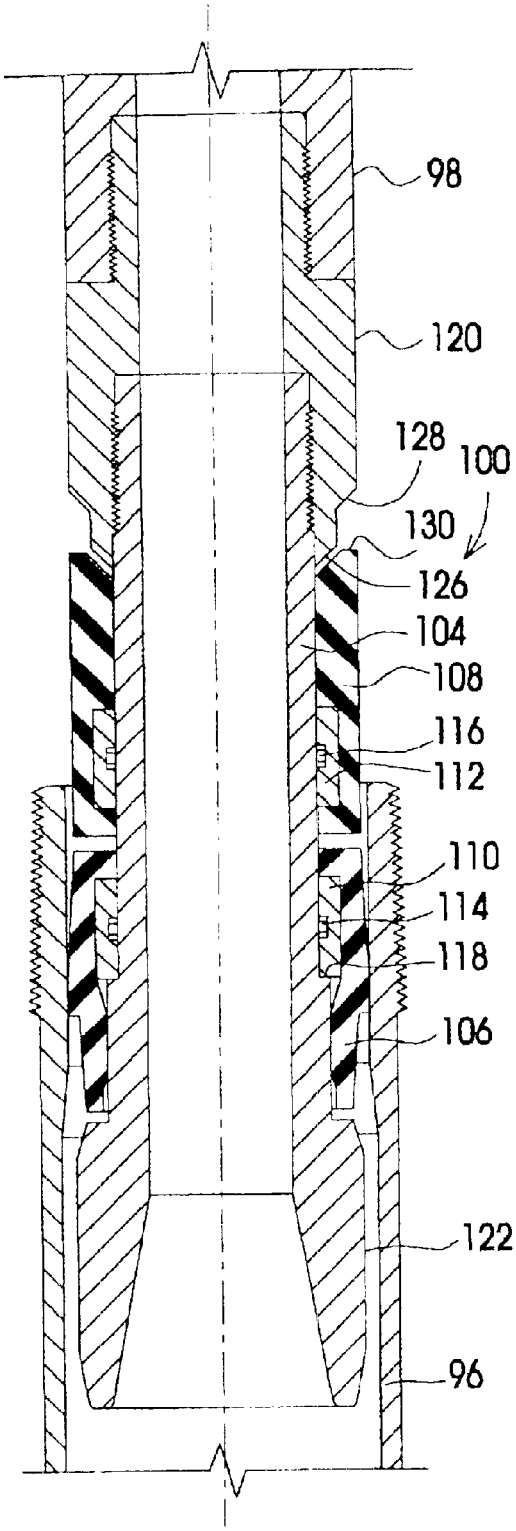
FIG. 1 Prior Art.
FIGS. 1, 2 and 3 are cross-sectional diagrams showing a prior art pack-off nipple assembly in different working conditions.
Figure 2:
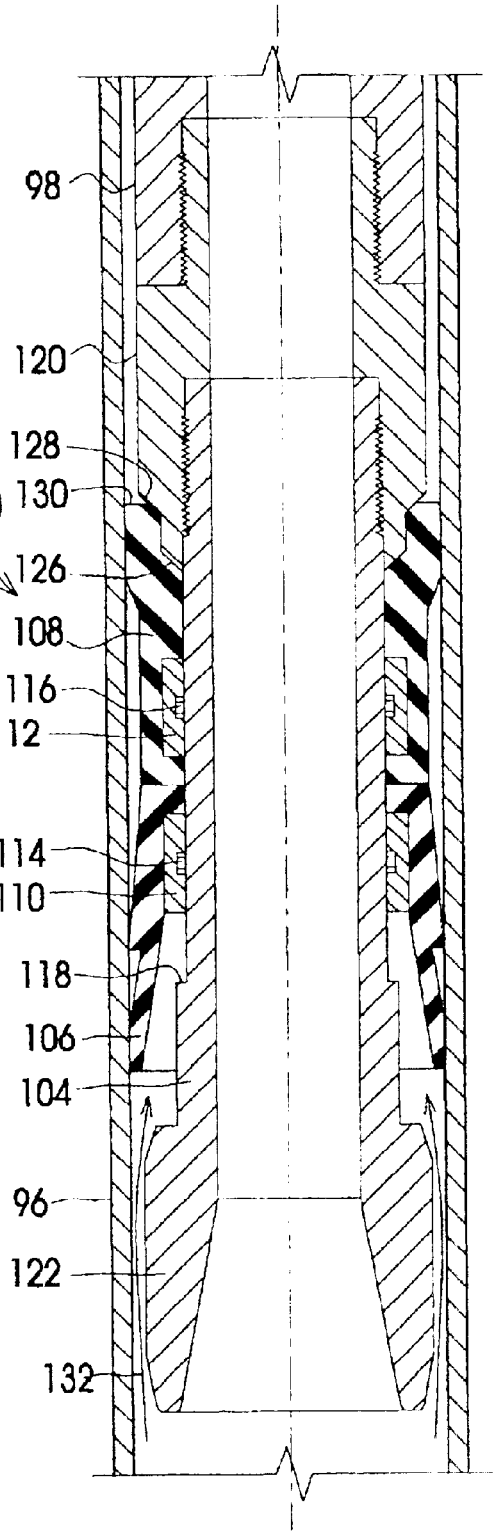
FIG. 2 Prior Art.
Figure 3:
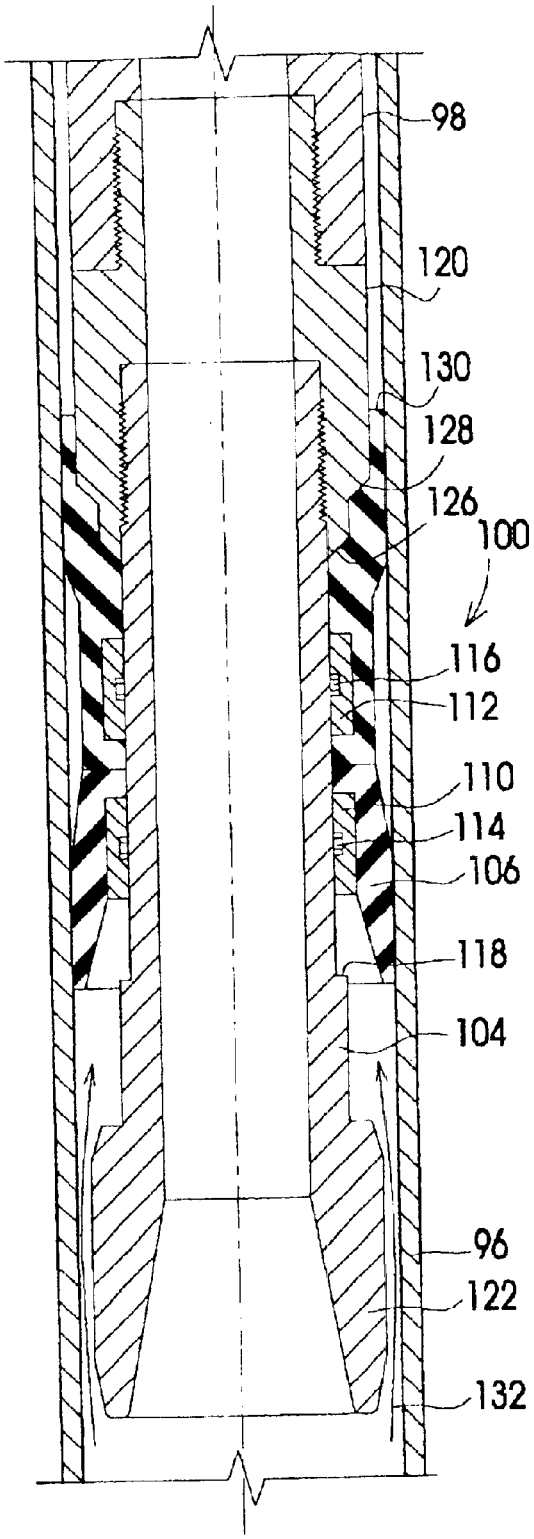
FIG. 3 Prior Art.

The elastomeric cups 210, 610, 610' described above are preferably unitary cups made of an elastomeric material having a uniform durometer of about 80–90. The elastomeric cups 210, 610, 610' are therefore simple and inexpensive to manufacture. It should be noted, however, that although the invention has been described with reference to unitary cups, itis equally suitable for use with two-part sealing elements such as shown in FIGS. 1–3 for example. The invention is adapted to be used on any cup tool and will enhance the performance of the cup tool by facilitating a more reliable seal when exposed to elevated fluid pressures.

Modifications and improvements to the above-described embodiments of the present invention may become apparent to those skilled in the art. The foregoing description is intended to be exemplary rather than limiting. The scope of the invention is therefore intended to be limited solely by the scope of the appended claims.

I claim:

1. A cup tool for providing a high-pressure fluid seal in an annulus between a high pressure mandrel and a casing or a production tubing in a wellbore, comprising:

a cup tool tube having a threaded upper end for connection to the high-pressure mandrel;

a stepped shoulder at an upper end of the cup tool tube, the stepped shoulder including at least two substantially right-angled steps; and an elastomeric sealing element that is slidably received on the cup tool tube, the elastomeric sealing element having a top end with a square top edge that engages the stepped shoulder when the elastomeric sealing element is forced upwardly over the cup tool tube by fluid pressure;

whereby the top end of the elastomeric sealing element is adapted to be forced upwardly and over one or more of the right-angled steps when the elastomeric sealing element is exposed to elevated fluid pressures, thereby extruding into the annulus in order to provide the high-pressure fluid seal.

2. A cup tool as claimed in claim 1 wherein each of the substantially right-angled steps comprises a radial surface, an axial surface and a rounded edge between the radial and the axial surfaces.

3. A cup tool as claimed in claim 1 wherein the elastomeric sealing element is bonded to a cylindrical metal ring having an inner diameter that is sized to slide over an outer diameter of the cup tool tube.

4. A cup tool as claimed in claim 3 wherein the cylindrical metal ring includes a groove in an inner periphery thereof that receives an O-ring, which provides a fluid seal between the metal ring and the cup tool tube.

5. A cup tool as claimed in claim 4 wherein the elastomeric sealing element comprises a unitary elastomeric cup.

6. A cup tool as claimed in claim 5 wherein the unitary elastomeric cup comprises a single elastomer of a consistent durometer.

7. A cup tool as claimed in claim 3 wherein the cup tool tube comprises a stop member to restrain downward movement of the elastomeric sealing element on the cup tool tube.

8. A cup tool as claimed in claim 1 wherein the cup tool tube has a bottom end that terminates in a bull nose for guiding the cup tool into the tubing.

9. A cup tool as claimed in claim 1 wherein the stepped shoulder is integrally formed with the cup tool tube.

10. A cup tool as claimed in claim 1 wherein the stepped shoulder is machined into an outer periphery of a gauge ring that is detachable from the threaded upper end of the cup tool tube.

11. A cup tool as claimed in claim 10 wherein the gauge ring further comprises a groove in an inner periphery thereof, which accommodates an O-ring for providing a seal between the cup tool tube and the gauge ring.

12. A cup tool as claimed in claim 1 further comprising a second cup tool tube, the cup tool comprising first and second axially spaced-apart stepped shoulders and first and second elastomeric sealing elements.

13. A gauge ring for a cup tool, comprising:

an outer periphery that includes a stepped shoulder having at least two substantially right-angle steps that respectively include a radial surface and an axial surface oriented at a right angle with respect to each other, the right angle steps being mounted above an elastomeric sealing element slidably surrounding a cup tool tube of the cup tool, the right angle steps being configured to inhibit upward movement of the elastomeric sealing element until the elastomeric sealing element is exposed directly or indirectly to fluid pressure high enough to force a square top end of the elastomeric sealing element upwardly over at least one of the right angle steps.

14. The gauge ring as claimed in claim 13 further comprising an inner periphery that includes an annular groove for supporting an O-ring adapted to provide a fluid seal between the gauge ring and a cup tool tube that supports the gauge ring.

15. The gauge ring as claimed in claim 13 further comprising an inner periphery that includes a spiral thread adapted to engage a complimentary spiral thread on an outer periphery of one of a cup tool tube and a connector sub adapted to connect the cup tool tube to a high pressure mandrel.

16. A cup tool for providing a high-pressure fluid seal in an annulus between a high pressure mandrel and a casing or a production tubing in a wellbore, comprising:

a first cup tool tube having a threaded upper end for connection to the high-pressure mandrel;

a first stepped shoulder at an upper end of the first cup tool tube, the first stepped shoulder including at least two substantially right-angled steps;

a first elastomeric sealing element that is slidably received on the first cup tool tube, the first elastomeric sealing element having a top end with a square top edge that engages the first stepped shoulder when the first elastomeric sealing element is forced upwardly over the first cup tool tube by fluid pressure;

a second cup tool tube having a threaded upper end for connection to the first cup tool tube;

a second stepped shoulder at an upper end of the second cup tool tube, the second stepped shoulder including at least two substantially right-angled steps; and a second elastomeric sealing element that is slidably received on the second cup tool tube, the second elastomeric sealing element having a top end with a square top edge that engages the second stepped shoulder when the second elastomeric sealing element is forced upwardly over the second cup tool tube by fluid pressure;

whereby the top end of the respective first and second elastomeric sealing elements is adapted to be forced upwardly against and over one or more of the respective right-angled steps when the elastomeric sealing element is exposed to elevated fluid pressures, thereby extruding into the annulus in order to provide the high-pressure fluid seal.

17. A cup tool as claimed in claim 16 wherein the elastomeric sealing elements are unitary elastomeric cups.

18. A cup tool as claimed in claim 17 wherein the elastomeric sealing elements are bonded to respective cylindrical metal ring sized to slide reciprocally on the respective first and second cup tool tubes, the cylindrical metal rings respectively including an inner peripheral groove adapted to support an O-ring for providing a fluid seal between the elastomeric sealing element and the respective cup tool tube.

19. A cup tool as claimed in claim 17 wherein the unitary elastomeric cups comprise a single elastomer of a consistent durometer of hardness.

20. A cup tool as claimed in claim 16 further comprising a bullnose that terminates the second cup tool tube, the bullnose being adapted to guide the cup tool through a wellhead as the high pressure mandrel is inserted therethrough.

21. A cup tool as claimed in claim 16 wherein the first and second stepped shoulders at a top end of the respective first and second cup tool tubes comprises a gauge ring that is detachably supported at a top of the respective first and second cup tool tubes.

* * * * *